US005244354A

United States Patent [19]

Nicol

[11] Patent Number: 5,244,354

[45] Date of Patent: Sep. 14, 1993

[54] FUEL PUMPING APPARATUS

[75] Inventor: Stuart W. Nicol, London, England

[73] Assignee: Lucas Industries public limited company, West Midlands, England

[21] Appl. No.: 13,575

[22] Filed: Feb. 4, 1993

[30] Foreign Application Priority Data

Feb. 29, 1992 [GB] United Kingdom ..... 9204417

[51] Int. Cl.[5] ..... F04B 1/06

[52] U.S. Cl. ..... 417/219; 417/462; 123/502

[58] Field of Search ..... 417/219 O, 221, 462; 123/502, 450

[56] References Cited

U.S. PATENT DOCUMENTS

| | | | |
|---|---|---|---|
| 4,108,130 | 8/1978 | Bailey | 417/462 |
| 4,362,141 | 12/1982 | Mowbray | 123/502 |
| 4,401,088 | 8/1983 | Morin | 123/502 |
| 4,491,116 | 1/1985 | Morin | 123/502 |
| 4,509,490 | 4/1985 | Morin | 123/502 |
| 4,550,702 | 11/1985 | Djordjevic | 417/462 |
| 4,552,117 | 11/1985 | Djordjevic | 417/462 |

FOREIGN PATENT DOCUMENTS

| | | | |
|---|---|---|---|
| 1008737 | 11/1965 | United Kingdom | 123/502 |

*Primary Examiner*—Richard A. Bertsch
*Assistant Examiner*—Alfred Basichas
*Attorney, Agent, or Firm*—Trexler, Bushnell, Giangiorgi & Blackstone, Ltd.

[57] ABSTRACT

A fuel pumping apparatus has a fixed body in which is defined bores containing pumping plungers. The plungers are moved inwardly by cam lobes on a rotatable cam ring to displace fuel to an associated engine. The cam ring is provided with an annular extension within which is located a drive shaft. The drive shaft is coupled to the extension of the cam ring by means of a tongue and slot connection. The tongue is carried on a push member mounted in the drive shaft and movable by means of a piston and the tongue and slot are arranged so that as the piston moves, relative angular movement will take place between the drive shaft and cam ring.

6 Claims, 4 Drawing Sheets

FUEL PUMPING APPARATUS

This invention relates to a fuel pumping apparatus comprising a plurality of cam actuated pumping plungers mounted within a bore formed in a body and a cam ring rotatable about the body, the cam ring having cam lobes which impart inward movement to the pumping plungers, fuel displaced during the inward movement of the plungers flowing to an outlet, the apparatus also including a drive shaft and means coupling the drive shaft to the cam ring, said means being adjustable so that the angular relationship between the cam ring and the drive shaft can be varied.

An apparatus of the aforesaid kind is disclosed in our pending application PCT/GB92/02331 in which the coupling means is in the form of a sleeve which is axially slidable about an annular extended portion of the drive shaft within which the cam ring is mounted The cam ring has an extended portion which has a driving connection with the sleeve which in turn has a driving connection with the drive shaft At least one of said connections is constructed so that when axial movement is imparted to the sleeve, relative angular movement will occur between the sleeve and the other component of the connection. As a result the angular relationship between the cam ring and the drive shaft will vary, the practical effect being that the timing of fuel delivery through the outlet is varied.

A disadvantage of the aforesaid arrangement is the considerable diameter of the apparatus owing to the fact that the drive shaft extends about the cam ring and the aforesaid sleeve is mounted about the drive shaft and an object of the invention is to provide an apparatus which for a given cam ring diameter has a reduced diameter at least in the plane of the cam ring.

According to the invention in an apparatus of the kind specified the cam ring includes an extended portion in which the drive shaft is located and said means includes a fluid pressure operable piston mounted in the drive shaft, a member carried by the drive shaft and movable radially by the piston, and a tongue and slot connection between said member and the extended portion of the cam ring, said connection being arranged so that movement of the member by the piston will impart relative angular movement between the cam ring and the drive shaft.

An example of a fuel pumping apparatus in accordance with the invention will now be described with reference to the accompanying drawings in which:

FIG. 1 is a sectional side elevation of part of the apparatus,

FIGS. 2 and 3 are cross-sections on the lines 2—2 and 3—3 of FIG. 1,

FIG. 6 is a view to an enlarged scale of part of

Figure 1:
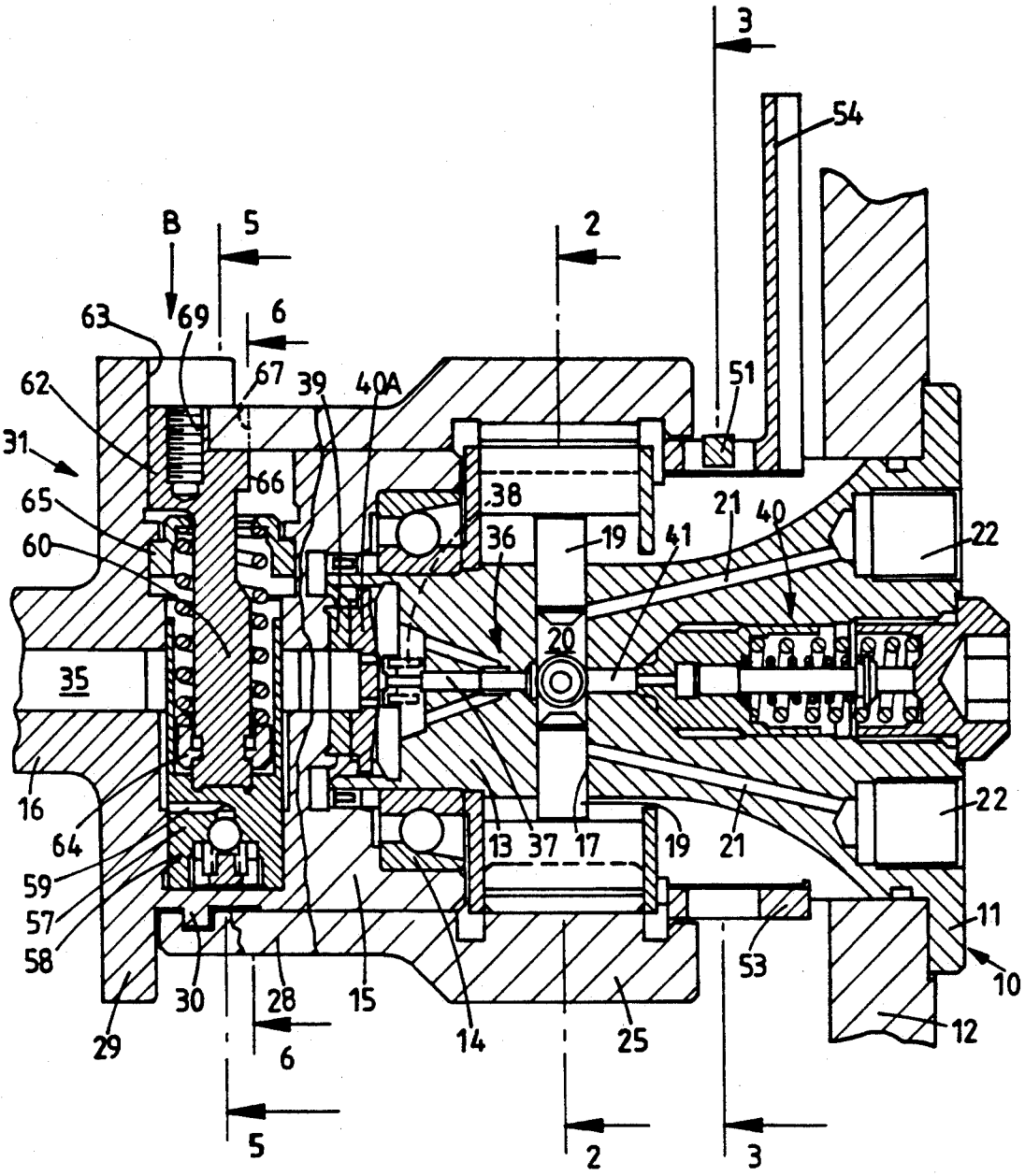

Referring to the drawings the apparatus comprises a stepped cylindrical main body 10 having a flange 11 which locates against a portion 12 of the housing of the further bearings not shown within the housing and in use is driven in timed relationship with the associated engine Formed in the body 10 is in the particular example, a pair of transversely extending bores 17 the axes of which are disposed at right angles to each other and normal to the axis of rotation of the drive shaft The outer ends of the bores open into slots 18 respectively which are formed in the main body. Each bore 17 accommodates a pair of pumping plungers 19 The inner ends of the plungers are of frusto-conical form and the inner ends of the plungers together with the bores form a pump working chamber 20.

Communicating with the bores at positions on opposite sides of the point of intersection of the bores, are outlet passages 21 respectively and these communicate with outlets 22 in the main body and which in use, are connected to the injection nozzles of the associated engine.

Located in the slots 18 are cam followers each of which comprises a roller 23 and a shoe 24. As more clearly seen in FIG. 2, the shoes engage the outer ends of the plungers and the rollers engage the internal peripheral surface of an annular cam ring 25. On the internal surface of the cam ring there is formed a plurality of cam lobes 26 there being in the particular example one less cam lobe than the number of plungers The angular spacing of the cam lobes is equal and is as if there were four cam lobes In place of the missing cam lobe there is formed a recess 27 and the depth of the recess is such that when a roller is engaged therewith, the associated plunger moves outwardly to a position to expose the entrance into the bore 17 of the associated outlet passage 21.

The cam ring 25 is provided with an annular extension 28 within which is located the portion 15 of the drive shaft. The portion 15 of the drive shaft is provided with a flange 29 adjacent the end of the extension 28 of the cam ring and spaced inwardly of the flange are a series of circumferentially spaced ribs 30. The inner surface of the extension is provided with a slot in which the ribs 30 can locate to retain the drive shaft and cam ring against relative axial movement. The portion of the extension 28 which lies intermediate the flange 29 and the slot is provided with a series of openings through which the ribs 30 can be passed during assembly, after which the cam ring and drive shaft are moved angularly to engage the ribs in the slot thereby to prevent relative axial movement but at the same time allowing relative angular movement. Coupling means generally indicated at 31 is provided to transmit the rotary motion of the drive shaft to the cam ring, the coupling means which is to be described, also providing for adjustment of the angular relationship between the drive shaft and the cam ring.

Fuel is supplied to the working chamber 20 from a low pressure fuel supply pump (not shown) the rotary part of which is connected to the drive shaft 16. The drive shaft 16 defines a passage 35 which communicates with the outlet of the low pressure fuel supply pump and which by way of a poppet valve 36 communicates with the pump working chamber. The valve member 37 of the poppet valve is biased to the closed position by means of a spring 38 and the valve is lifted from its seating by the action of a face cam and follower, the face cam being indicated at 39 and being secured to the drive shaft and the follower being indicated at 40A and being non-rotatably mounted in but axially movable relative to the spigot portion 13 of the main body 10.

In order to control the amount of fuel which is supplied by the apparatus to the associated engine there is provided a spill valve 40 which will be described in greater detail, and this controls the flow of fuel through a spill passage 41 which communicates with the pump working chamber 20.

Figure 2:
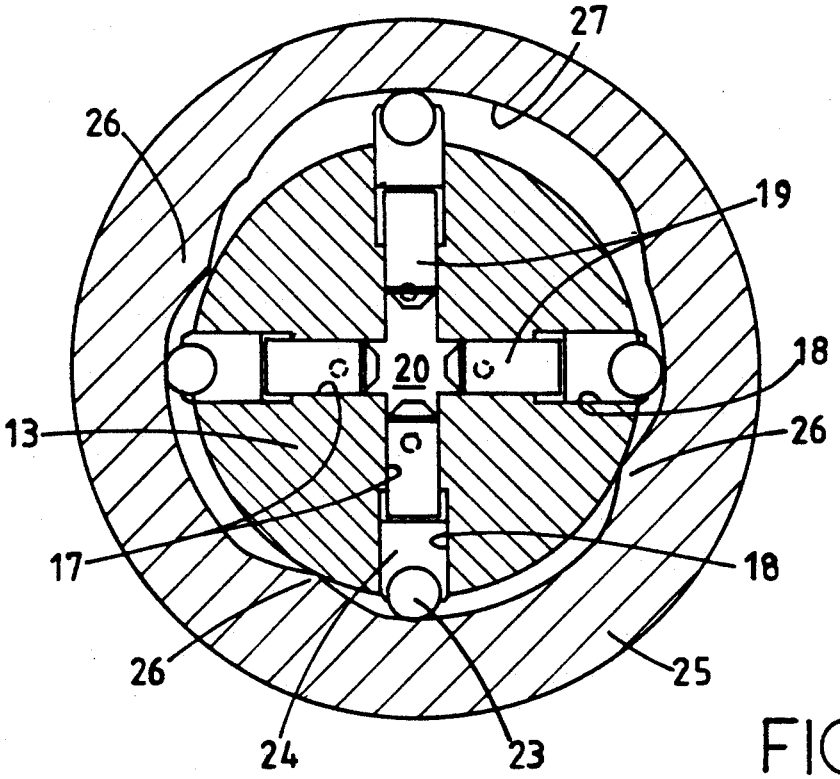

In operation, and with the parts of the apparatus occupying the positions shown in the drawing, the filling of the working chamber 20 has been completed and all the plungers 19 have been moved outwardly their maximum extent. As the drive shaft and cam ring 25 rotate (in the counterclockwise direction as seen in FIG. 2) three of the rollers 23 engage the leading flanks of the cam lobes 26 and the associated plungers 19 move inwardly to displace fuel from the working chamber. The other plunger has moved outwardly as allowed by the recess 27, so that the associated passage 21 is uncovered to the working chamber and as the rollers climb the leading flanks of the cam lobes the fuel expelled from the working chamber will be delivered to one of the outlets 22. Before the rollers reach the crests of the cam lobes the spill valve 40 is operated so that the remaining quantity of fuel which is displaced from the working chamber flows along the spill passage 41. The pressure of fuel in the working chamber is therefore reduced and the appropriate one of the delivery valves (not shown) which are mounted in the outlets 22 respectively, will close to relieve the pressure in the pipeline interconnecting the outlet with the respective injection nozzle. Relief of the pressure in the pipeline takes place with the fuel being returned to the working chamber. During continued rotation of the drive shaft the poppet valve 36 is lifted to allow fuel to flow into the working chamber 20 from the passage 35 moreover, during this movement the plunger which was previously in the recess 27 is moved inwardly and the remaining plungers move outwardly as permitted by the trailing flanks of the cam lobes 26. Moreover, the next plunger moves outwardly a further amount as it moves into the recess 27. The cycle of operation is repeated and fuel is supplied to the outlets in turn.

Figure 3:
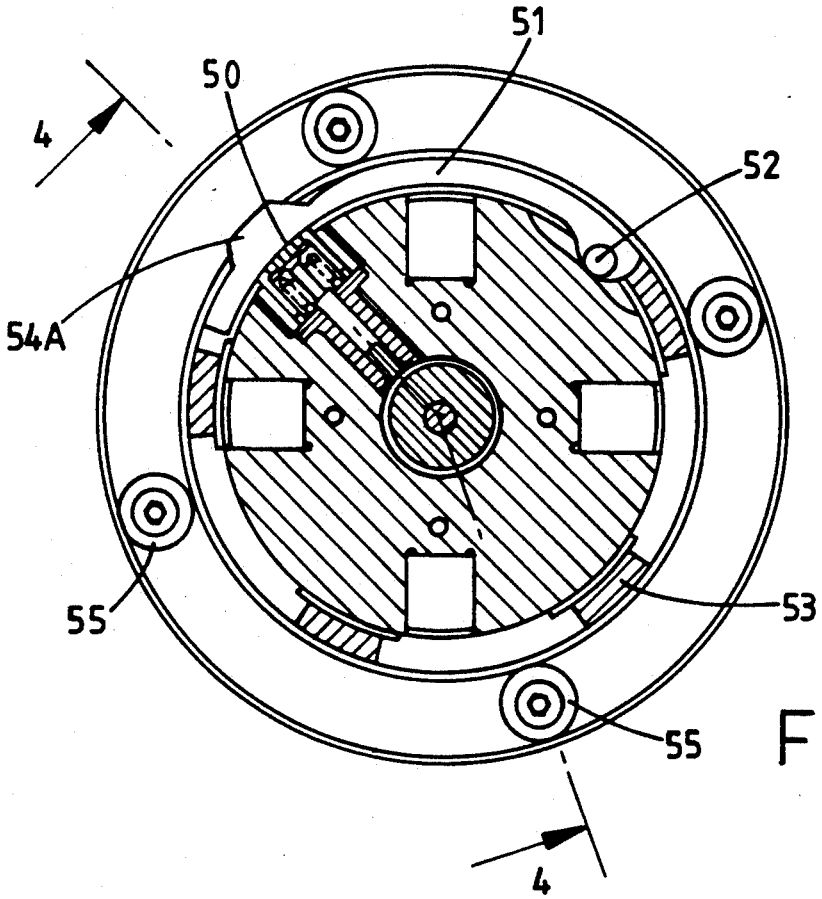
Figure 4:
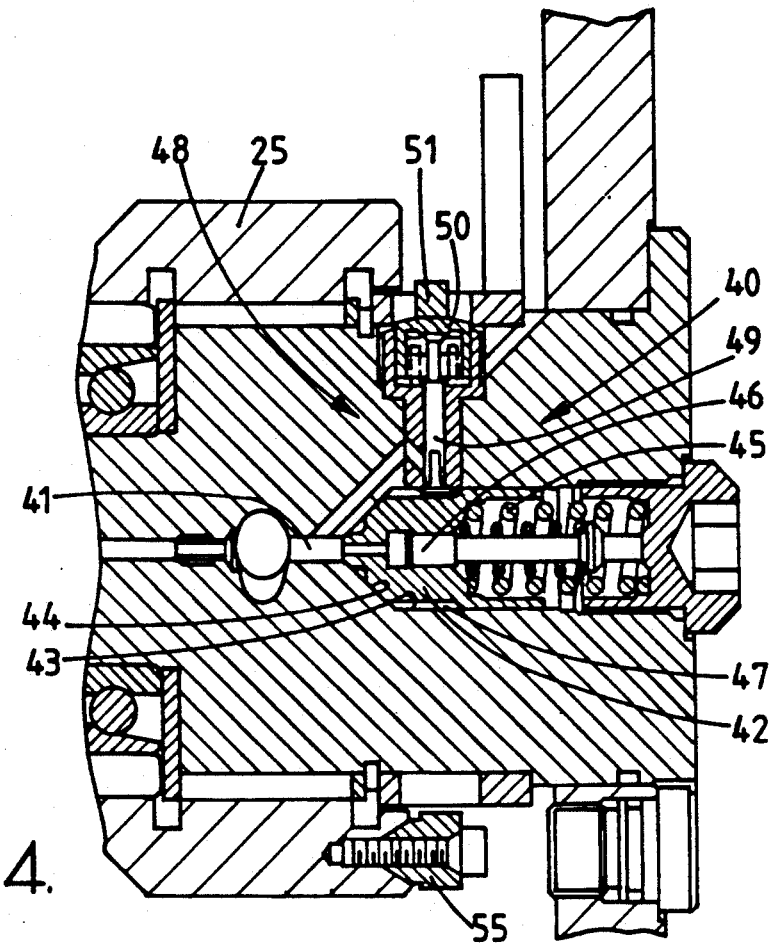
FIG. 4 is a section on the line 4—4 of FIG. 3.
Figure 5:
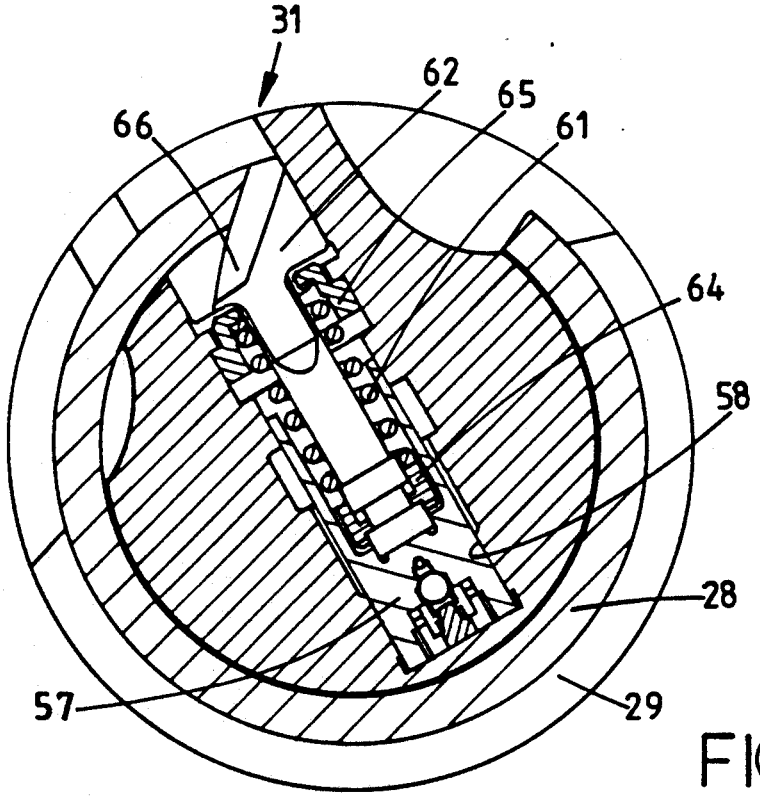
FIG. 5 is a section on the line 5—5 of FIG. 1.
Figure 6:
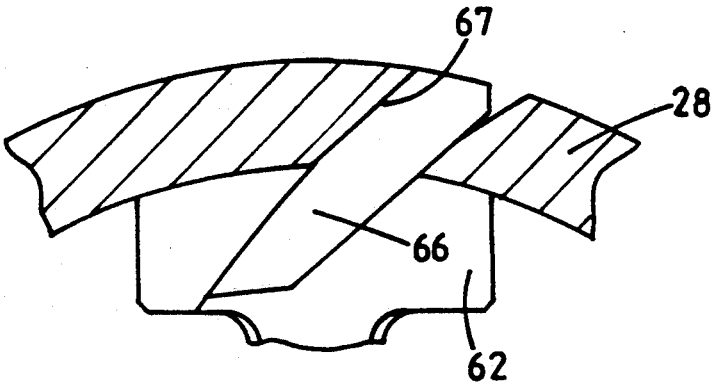

With particular reference to FIG. 4, the spill valve 40 comprises a valve member 42 movable in a cylinder 43 into the end of which the spill passage 41 opens. Surrounding the entrance of the spill passage 41 into the cylinder 43 is a seating 44 and the valve member 42 has a portion of smaller diameter which is shaped for cooperation with the seating. The valve member is biased into engagement with the seating by a coiled compression spring 45 and a pressure balancing piston 46 is located within a bore which is formed in the valve member 42 and which communicates with the passage 41. The valve member and the cylinder define an annular space 47 to which fuel under pressure from the spill passage 41 can be admitted by the action of a control valve 48. This valve comprises a poppet valve member 49 which is spring loaded to the closed position. The valve includes an actuating cup 50 which is engaged by a pivotally mounted curved beam 51. The beam 51 as shown in FIG. 3, is provided with a pivot 52 and is carried on an angularly adjustable ring member 53 associated with which is a control lever 54 (FIG. 1). The outer surface of the beam is provided with a projection 54A which is engagable by cam elements 55 which are secured to the cam ring 25 as seen in FIG. 4. Conveniently the cam elements are of cylindrical form but their external surfaces are eccentric relative to the aperture therethrough so that the cam elements can be angularly adjusted by loosening the securing bolts which pass through the apertures.

When during inward movement of the plungers 19, the control valve 48 is actuated, fuel under pressure is supplied to the annular space 47 and acts upon the valve member 42 to lift it from its seating. Once this takes place the remaining quantity of fuel which is displaced from the pump working chamber 20 flows into the cylinder 43 to displace the valve member against the action of its spring loading. The fuel which is retained within the cylinder 43 is returned at the commencement of the following filling stroke. By moving the lever 54 and therefore the arm 51 angularly about the axis of rotation of the drive shaft, the instant during the inward movement of the plungers 19 at which the spill valve 40 is operated, can be controlled and thereby the amount of fuel which is supplied to the associated engine can be controlled. The facility to adjust the cam elements 55 means that the pump can be adjusted to ensure that for a given angular setting of the lever 54, each outlet will receive the same amount of fuel.

The coupling means 31 will now be described with reference to FIGS. 1, 5, 6 and 7. The coupling means includes a piston 57 which is housed within a blind diametrically disposed bore 58 formed in the portion 15 of the drive shaft adjacent the flange 29. Formed in the piston is a passage 59 which by way of a ball check valve mounted in the piston, communicates with the blind end of the bore. The passage 59 communicates with the passage 35 in the drive shaft by way of an enlarged portion of the bore, so that the inner end of the piston is exposed to the outlet pressure of the low pressure fuel supply pump the outlet pressure of which is arranged to vary in accordance with the speed of the associated engine. As an alternative a separate passage can be formed in the drive shaft to convey fluid at a control pressure to the blind end of the bore 58 so that it can act upon the inner end of the piston 57.

The piston 57 is of cup shaped form and located in the piston is a push member 60 which has its inner end held in engagement with the internal base wall by means of a coiled compression spring 61. The push member extends beyond the open end of the piston and is formed with a head 62 which is shaped for engagement with a cylindrical surface 63 which is concentric with the bore 58. The spring 61 is located between a pair of spring abutments 64, 65 the first of which is engaged with the member 60 and the second of which is engaged within a counter bore which is formed in the portion 15 of the drive shaft and is of slightly larger diameter than the bore 58.

The spring abutments and the associated parts define bayonet connections and the force exerted by the spring 61 serves to prevent disengagement of the bayonet connections and also serves to bias the push member 60 into engagement with the piston. In addition, the spring biases the piston against the action of the fuel pressure in the blind end of the bore.

The head 62 is machined to define an inclined tongue 66 which is located in a complementary slot 67 which is formed in a recessed portion of the end surface of the extension 28 of the cam ring. The profiles of the side surfaces of the tongue together with those of the slot are such that there is a constant velocity ratio between the diametral movement of the tongue and the angular movement of the cam ring while the backlash is kept constant over the range of movement. Moreover, the area of contact between the face of the tongue which carries the driving load imparted to the cam ring, together with the associated face of the slot is relatively large as compared with the area of contact between the other faces of the tongue and the slot. In addition, the area of contact between the head 62 and the cylindrical surface 63 is made larger as will be seen from FIG. 7, to cope with the load. Moreover, an end face of the extension bears against a side face 68 of the head 62 in order to prevent twisting of the head.

In order to assemble the various components of the coupling means, the piston 57 is first pushed into the bore 58. The push member 60, the spring 61 and the spring abutments 64, 65 are then assembled together and a spacer is interposed between the head 62 and the spring abutment 65. The push member is then pushed into the piston and the spring abutment 65 engaged in the counter bore after which the spacer is removed. This portion of the assembly is carried out before the extension 28 is located in position.

Figure 7:
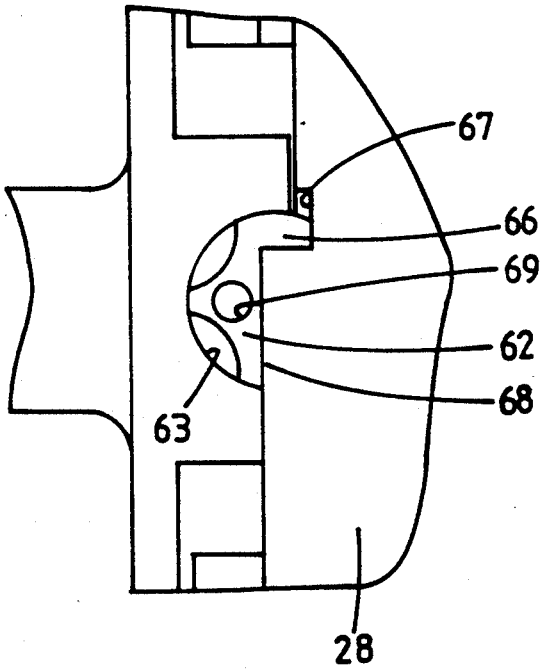
FIG. 7 is a view in the direction of the arrow B of FIG. 1.

As will be seen from FIGS. 1 and 7 the head 62 is provided with a threaded aperture 69 which can be engaged by a tool to enable the head to be moved outwardly against the action of the spring 61 to a position to allow the extension 28 to be located in position as previously described. The head is then allowed to return under the action of the spring after the tongue 66 has been located in the slot 67.

It is arranged that the piston 57 and the push member are substantially balanced about the axis of rotation of the drive shaft so that centrifugal forces acting on the various components are substantially balanced.

In use, with increasing engine speed the output pressure of the low pressure pump increases which moves the piston 57 and the push member 60 outwardly against the action of the spring 61. As a result relative angular movement takes place between the drive shaft and the cam ring in the direction to advance the timing of fuel delivery to the engine. As the engine speed decreases the spring moves the push member and the piston inwardly and the timing of fuel delivery is retarded.

The construction as described allows the apparatus to have a reduced overall diameter and in addition, there are fewer parts as compared with our prior apparatus.

It will be noted that the axis of the piston 57 and the push member 60 is inclined about the axis of rotation of the drive shaft relative to the diametral axes which contain the cam lobes. This is to ensure that the driving force which is applied to the cam ring is approximately in line with the resultant force which is applied by the cam rollers. This minimises the risk of the cam ring skewing.

I claim:

1. A fuel pumping apparatus for supplying fuel to an internal combustion engine comprising a plurality of cam actuated pumping plungers mounted within a bore or bores formed in a body, a cam ring rotatable about the body, the cam ring having cam lobes which impart inward movement to the pumping plungers, fuel displaced during the inward movement of the plungers flowing to an outlet, a drive shaft and means coupling the drive shaft to the cam ring, said means being adjustable so that the angular relationship between the cam ring and the drive shaft can be varied, the cam ring including an extended portion in which the drive shaft is located and said means includes a fluid pressure operable piston mounted in the drive shaft, a member carried by the drive shaft and movable radially by the piston, and a tongue and slot connection between said member and the extended portion of the cam ring, said connection being arranged so that movement of the member by the piston will input relative angular movement between the cam ring and drive shaft.

2. An apparatus according to claim 1, in which said member includes a head of part cylindrical form, said head engaging with a part cylindrical surface defined on the drive shaft, said head mounting the tongue of the tongue and slot connection.

3. An apparatus according to claim 2, in which said member at its end remote from the head is engaged by said piston, the piston being housed in a bore concentric with said cylindrical surface and by spring means operable to bias the member in opposition to the force generated by the fluid pressure acting on the piston.

4. An apparatus according to claim 3, in which said spring means comprises a coiled compression spring which surrounds said member, and a pair of spring abutments between which the spring is located, the first abutment being engaged with the member and the second abutment being secured within a counter bore formed in the drive shaft and concentric with the bore.

5. An apparatus according to claim 4, in which said spring abutments are secured by bayonet type connections to the member and drive shaft.

6. An apparatus according to claim 2, including means operable to prevent relative axial movement of the cam ring and drive shaft.

* * * * *